US010637153B2

(12) United States Patent
Luo et al.

(10) Patent No.: US 10,637,153 B2
(45) Date of Patent: Apr. 28, 2020

(54) REFLECTOR ANTENNA AND ANTENNA ALIGNMENT METHOD

(71) Applicant: Huawei Technologies Co., Ltd., Shenzhen, Guangdong (CN)

(72) Inventors: Yanxing Luo, Chengdu (CN); Hao Long, Shenzhen (CN); Fusheng Tang, Shenzhen (CN); Zhuo Zeng, Chengdu (CN)

(73) Assignee: HUAWEI TECHNOLOGIES CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/962,769

(22) Filed: Apr. 25, 2018

(65) Prior Publication Data

US 2018/0248269 A1 Aug. 30, 2018

Related U.S. Application Data

(63) Continuation of application No. PCT/CN2015/092854, filed on Oct. 26, 2015.

(51) Int. Cl.

*H01Q 19/17* (2006.01)
*H01Q 21/00* (2006.01)
*H01Q 3/26* (2006.01)

(52) U.S. Cl.

CPC ..... *H01Q 19/17* (2013.01); *H01Q 3/2605* (2013.01); *H01Q 3/2658* (2013.01); *H01Q 21/0025* (2013.01)

(58) Field of Classification Search

CPC ..... H01Q 19/17; H01Q 3/36; H01Q 21/00
USPC ..... 343/839; 342/359; 333/101
See application file for complete search history.

(56) References Cited

U.S. PATENT DOCUMENTS 4,332,018 A * 5/1982 Sternberg ..... G10K 11/30 367/103
5,289,193 A * 2/1994 Lenormand ..... H01Q 25/007 342/373
5,936,588 A * 8/1999 Rao ..... H01Q 3/24 342/372
6,043,779 A 3/2000 Lalezari et al.
6,448,938 B1 * 9/2002 Chiang ..... H01Q 1/246 343/850

(Continued)

FOREIGN PATENT DOCUMENTS

CN 1276635 A 12/2000
CN 1539178 A 10/2004

(Continued)

*Primary Examiner* — Dean O Takaoka
(74) *Attorney, Agent, or Firm* — Womble Bond Dickinson (US) LLP

(57) ABSTRACT

Embodiments of the present disclosure provide a reflector antenna and an antenna alignment method. The reflector antenna includes: a feed array, including N feeds, where N is an integer greater than 1; a reflector, configured to: reflect a signal from the feed array or reflect a signal to the feed array; and M radio frequency channels, where the radio frequency channel includes at least one of an adjustable gain amplifier or a phase shifter, configured to control a signal, M is an integer greater than 1 and less than N, each radio frequency channel corresponds to one of the N feeds, a correspondence between the radio frequency channel and the feed is changeable, and the radio frequency channel transmits or receives a signal by using a corresponding feed.

7 Claims, 2 Drawing Sheets

(56) References Cited

U.S. PATENT DOCUMENTS

| | | | | |
|---|---|---|---|---|
| 6,504,504 | B1 | 1/2003 | Tits et al. | |
| 6,836,255 | B1 | 12/2004 | Davis | |
| 8,730,104 | B2 | 5/2014 | Sharawi | |
| 9,413,067 | B2 * | 8/2016 | Klemes | H01Q 3/36 |
| 2005/0200516 | A1 * | 9/2005 | Brown | G01S 13/32 342/90 |
| 2007/0080888 | A1 | 4/2007 | Mohamadi | |
| 2010/0117893 | A1 | 5/2010 | Dreher et al. | |
| 2012/0257653 | A1 | 10/2012 | Nagaishi et al. | |
| 2016/0020817 | A1 | 1/2016 | Chen et al. | |
| 2017/0279500 | A1 | 9/2017 | Zhao et al. | |

FOREIGN PATENT DOCUMENTS

| | | | |
|---|---|---|---|
| CN | 104718713 | A | 6/2005 |
| CN | 101056451 | A | 10/2007 |
| CN | 101825698 | A | 9/2010 |
| CN | 104049252 | A | 9/2014 |
| CN | 104539329 | A | 4/2015 |

* cited by examiner

| | | | |
|---|---|---|---|
| a1 | b1 | a2 | b2 |
| c1 | d1 | c2 | d2 |
| a3 | b3 | a4 | b4 |
| c3 | d3 | c4 | d4 |

REFLECTOR ANTENNA AND ANTENNA ALIGNMENT METHOD

CROSS-REFERENCE TO RELATED APPLICATIONS

This application is a continuation of International Application No. PCT/CN2015/092854, filed on Oct. 26, 2015, which is hereby incorporated by reference in its entirety.

TECHNICAL FIELD

Embodiments of the present application relate to the field of antenna technologies, and in particular, to a reflector antenna and an antenna alignment method.

BACKGROUND

An antenna is a critical device in wireless communication and microwave communication, and may implement mutual conversion between a high frequency electrical signal and a wireless signal or a microwave signal. In the wireless communication and the microwave communication, an antenna is used to transmit or receive a wireless signal or a microwave signal.

In the microwave communication, a reflector antenna is most used, and the reflector antenna includes a feed and a reflector. In a transmit state, a radio frequency channel sends a signal to the feed, and then a signal transmitted by the feed is radiated outwards by using reflection of the reflector; in a receive state, a received signal is reflected by the reflector to the feed and is transmitted to the radio frequency channel connected to the feed.

Alignment during installation of a high-gain antenna is quite time- and labor-consuming, and service interruption easily occurs due to tower shaking in the case of strong winds. Therefore, the antenna needs to have an alignment capability to facilitate installation alignment and resist shaking. However, efficiency of alignment by using antenna rotation is quite low.

SUMMARY

Embodiments of the present disclosure provide a reflector antenna and an antenna alignment method, to implement antenna alignment to facilitate installation alignment and resist shaking.

According to a first aspect, an embodiment of the present disclosure provides a reflector antenna, including: a feed array, including N feeds, where N is an integer greater than 1; a reflector, configured to: reflect a signal from the feed array or reflect a signal to the feed array; and M radio frequency channels, where the radio frequency channel includes at least one of an adjustable gain amplifier or a phase shifter, configured to control a signal, M is an integer greater than 1 and less than N, each radio frequency channel corresponds to one of the N feeds, a correspondence between the radio frequency channel and the feed is changeable, and the radio frequency channel transmits or receives a signal by using a corresponding feed.

With reference to the first aspect, in a first possible implementation of the first aspect, the antenna further includes M single-pole multi-throw switches, one radio frequency channel corresponds to one single-pole multi-throw switch, one single-pole multi-throw switch corresponds to a plurality of feeds, the radio frequency channel is connected to a single-pole end of the single-pole multi-throw switch, the feeds are connected to multi-throw ends of the single-pole multi-throw switch, and a correspondence between the radio frequency channel and the feeds is controlled by the single-pole multi-throw switch.

With reference to the first possible implementation of the first aspect, in a second possible implementation of the first aspect, the feeds are connected to the multi-throw ends of the single-pole multi-throw switch by using a cross waveguide.

With reference to any one of the first aspect, or the first and the second possible implementations of the first aspect, in a third possible implementation of the first aspect, the radio frequency channel includes a transmit radio frequency channel, the transmit radio frequency channel includes the phase shifter, and the phase shifter is configured to control a phase of a to-be-transmitted signal.

With reference to any one of the first aspect, or the first to the third possible implementations of the first aspect, in a fourth possible implementation of the first aspect, the radio frequency channel includes a transmit radio frequency channel, the transmit radio frequency channel includes the adjustable gain amplifier, and the adjustable gain amplifier is configured to control an amplitude of a to-be-transmitted signal.

With reference to either of the third or the fourth possible implementation of the first aspect, in a fifth possible implementation of the first aspect, a quantity of transmit radio frequency channels is O, and O is an integer greater than 1 and less than or equal to M; and the antenna further includes a divider, configured to: divide to-be-transmitted signals into O channels of signals and send the O channels of signals to the O transmit radio frequency channels respectively.

With reference to any one of the first aspect, or the first to the fifth possible implementations of the first aspect, in a sixth possible implementation of the first aspect, the radio frequency channel includes a receive radio frequency channel, the receive radio frequency channel includes the phase shifter, and the phase shifter is configured to control a phase of a received signal.

With reference to any one of the first aspect, or the first to the sixth possible implementations of the first aspect, in a seventh possible implementation of the first aspect, the radio frequency channel includes a receive radio frequency channel, the receive radio frequency channel includes the adjustable gain amplifier, and the adjustable gain amplifier is configured to control an amplitude of a received signal.

With reference to either of the sixth or the seventh possible implementation of the first aspect, in an eighth possible implementation of the first aspect, a quantity of receive radio frequency channels is P, and P is an integer greater than 1 and less than or equal to M; and the antenna further includes a combiner, configured to combine received signals of the P receive radio frequency channels.

According to a second aspect, an embodiment of the present disclosure provides an antenna alignment method, where the method uses the reflector antenna provided in the first aspect, and includes: setting a correspondence between a radio frequency channel and a feed as a test correspondence; detecting power of a signal received by each radio frequency channel; determining an alignment correspondence between the radio frequency channel and the feed according to the power of the signal received by the radio frequency channel, where in the alignment correspondence between the radio frequency channel and the feed, feeds corresponding to the radio frequency channel are adjacent; setting the correspondence between a radio frequency channel and a feed as the alignment correspondence; and transmitting or receiving, by the radio frequency channel, a signal by using a feed corresponding to the alignment correspondence.

With reference to the second aspect, in a first possible implementation of the second aspect, in the test correspondence, the feeds corresponding to the radio frequency channel are located at the edge of a feed array.

With reference to the second aspect, in a second possible implementation of the second aspect, in the test correspondence, the feeds corresponding to the radio frequency channel are evenly distributed around the center of a feed array.

With reference to any one of the second aspect, or the first and the second possible implementations of the second aspect, in a third possible implementation of the second aspect, the determining an alignment correspondence between the radio frequency channel and the feed according to the power of the signal received by the radio frequency channel specifically includes: determining a direction of arrival according to the power of the signal received by the radio frequency channel; and determining, according to the direction of arrival, the alignment correspondence between the radio frequency channel and the feed.

With reference to any one of the second aspect, or the first to the third possible implementations of the second aspect, in a fourth possible implementation of the second aspect, before the transmitting or receiving, by the radio frequency channel, a signal by using a feed corresponding to the alignment correspondence, the method further includes: adjusting a phase shifter of a receive radio frequency channel, and optimizing an MSE of a received signal obtained after the combiner performs combination.

With reference to any one of the second aspect, or the first to the fourth possible implementations of the second aspect, in a fifth possible implementation of the second aspect, before the transmitting or receiving, by the radio frequency channel, a signal by using a feed corresponding to the alignment correspondence, the method further includes: adjusting an adjustable gain amplifier of a receive radio frequency channel, and optimizing an MSE of a received signal obtained after the combiner performs combination.

The reflector antenna provided in the foregoing embodiments of the present disclosure includes: a feed array, including N feeds, where N is an integer greater than 1; a reflector, configured to: reflect a signal from the feed array or reflect a signal to the feed array; and M radio frequency channels, where the radio frequency channel includes at least one of an adjustable gain amplifier or a phase shifter, configured to control a signal, M is an integer greater than 1 and less than N, each radio frequency channel corresponds to one of the N feeds, a correspondence between the radio frequency channel and the feed is changeable, and the radio frequency channel transmits or receives a signal by using a corresponding feed. The correspondence between the radio frequency channel and the feed is changeable. Therefore, the radio frequency channel can compare receive power and/or phases of feeds, and then may select and correspond to a better feed to implement rough alignment, and after the correspondence between the radio frequency channel and the feed is determined, may further adjust phase shifters and/or adjustable gain amplifiers of all radio frequency channels, to implement fine alignment. The foregoing alignment process requires no rotation of the antenna, and high-efficiency antenna alignment may be implemented.

BRIEF DESCRIPTION OF DRAWINGS

To describe the technical solutions in the embodiments of the present disclosure more clearly, the following briefly describes the accompanying drawings required for describing the embodiments of the present disclosure. Apparently, the accompanying drawings in the following description show merely some embodiments of the present disclosure, and persons of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. Apparently, the described embodiments are some rather than all of the embodiments of the present disclosure. All other embodiments obtained by persons of ordinary skill in the art based on the embodiments of the present disclosure without creative efforts shall fall within the protection scope of the present disclosure.

Figure 1:
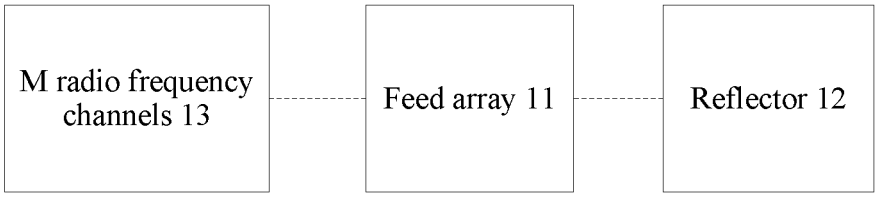
FIG. 1 is a structural diagram of a reflector antenna according to an embodiment of the present disclosure.

FIG. 1 shows a reflector antenna provided in an embodiment of the present disclosure.

The reflector antenna includes:

a feed array 11, including N feeds, where N is an integer greater than 1;

a reflector 12, configured to: reflect a signal from the feed array or reflect a signal to the feed array; and M radio frequency channels 13, where the radio frequency channel includes at least one of an adjustable gain amplifier or a phase shifter, configured to control a signal, M is an integer greater than 1 and less than N, each radio frequency channel corresponds to one of the N feeds, a correspondence between the radio frequency channel and the feed is changeable, and the radio frequency channel transmits or receives a signal by using a corresponding feed.

The correspondence between the radio frequency channel and the feed is changeable. Therefore, the radio frequency channel can compare receive power and/or phases of feeds, and then may select and correspond to a better feed to implement rough alignment, and after the correspondence between the radio frequency channel and the feed is determined, may further adjust phase shifters of all radio frequency channels, to implement fine alignment. The foregoing alignment process requires no rotation of the antenna, and high-efficiency antenna alignment may be implemented.

The correspondence between the radio frequency channel and the feed in FIG. 1 may be implemented by using M single-pole multi-throw switches. For example, the antenna may include M single-pole multi-throw switches, one radio frequency channel corresponds to one single-pole multi-throw switch, one single-pole multi-throw switch corresponds to a plurality of feeds, the radio frequency channel is connected to a single-pole end of the single-pole multi-throw switch, and the feeds are connected to multi-throw ends of the single-pole multi-throw switch, and a correspondence between the radio frequency channel and the feeds is controlled by the single-pole multi-throw switch. The feeds are connected to the multi-throw ends of the single-pole multi-throw switch by using a cross waveguide.

Figure 2:
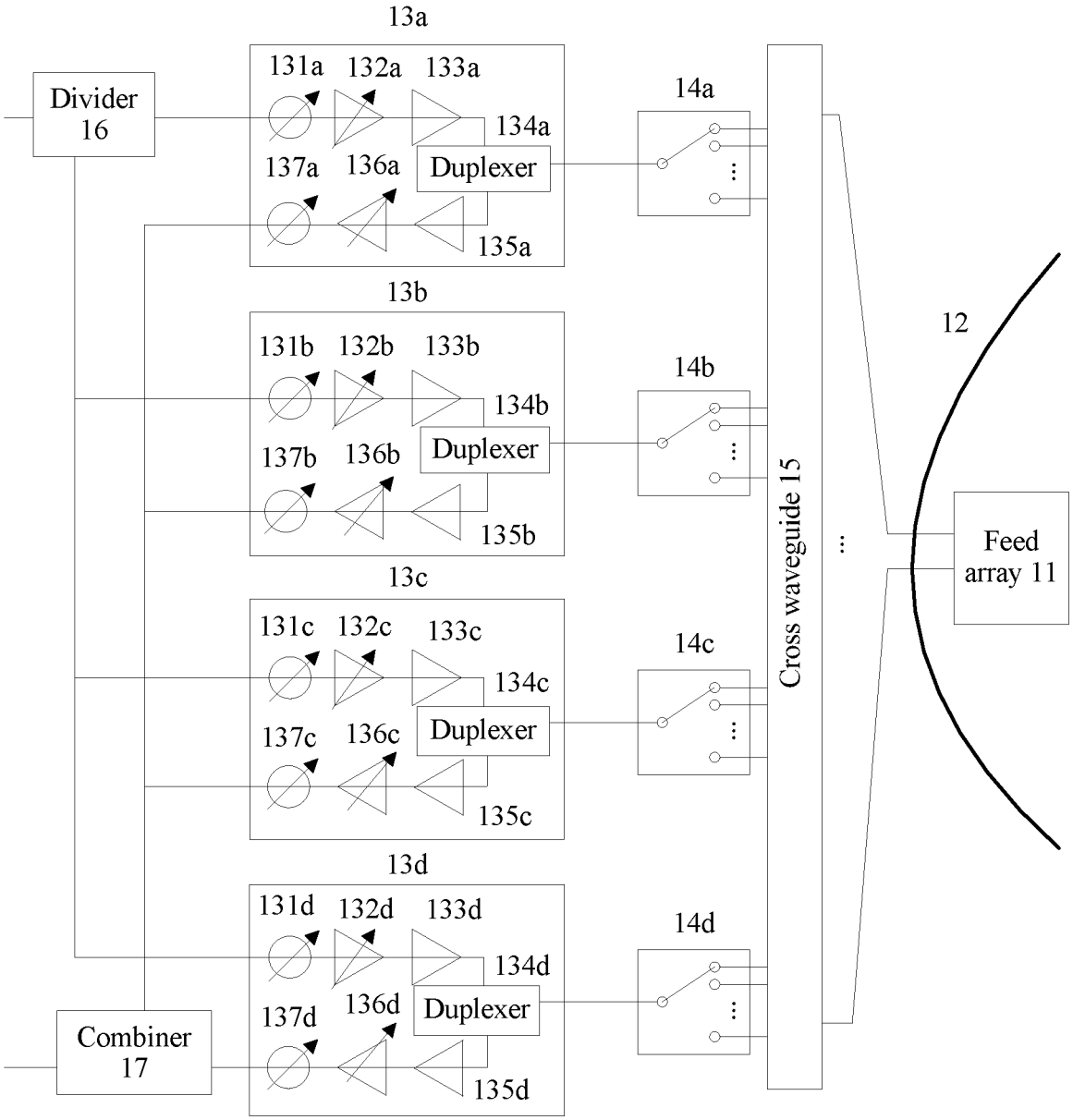
FIG. 2 is a structural diagram of another reflector antenna according to an embodiment of the present disclosure.
Figures 3, 4:
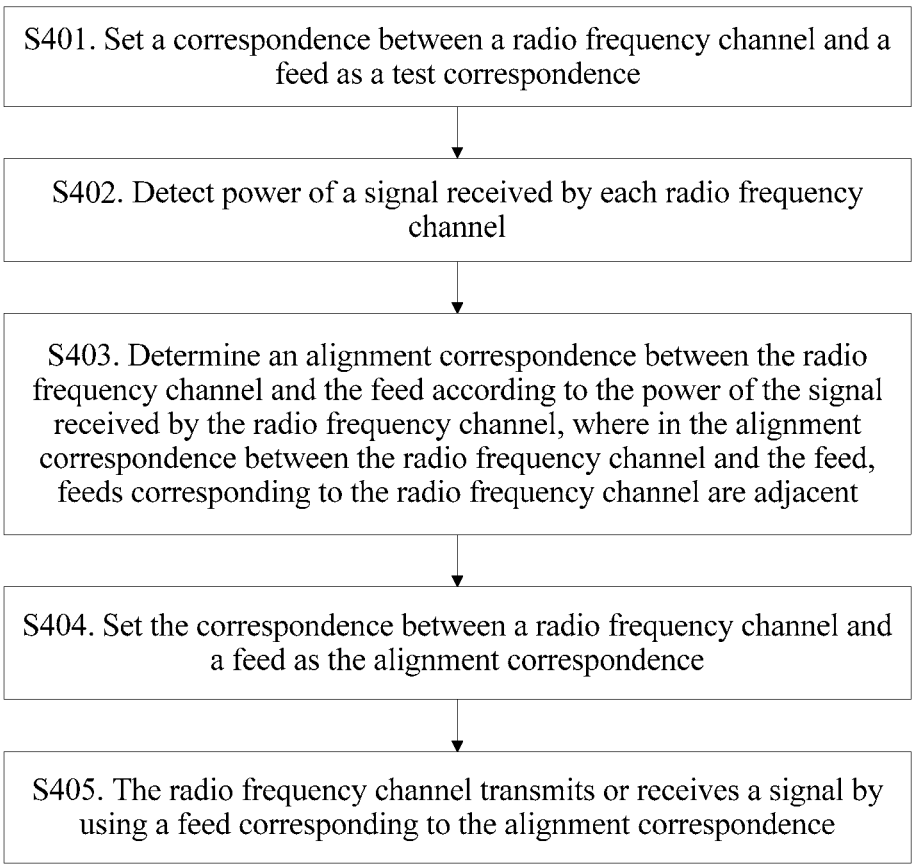
FIG. 3 is a structural diagram of a feed array according to an embodiment of the present disclosure.
FIG. 4 is a flowchart of an antenna alignment method according to an embodiment of the present disclosure.

FIG. 2 shows a reflector antenna provided in an embodiment of the present disclosure. FIG. 3 is an arrangement manner of the feed array 11 in the reflector antenna shown in FIG. 2. With reference to FIG. 2 and FIG. 3, the reflector antenna includes four radio frequency channels 13*a*, 13*b*, 13*c*, and 13*d*, and one reflector 12, and the feed array 11 includes 16 feeds (a1, a2, a3, a4, b1, b2, b3, b4, c1, c2, c3, c4, d1, d2, d3, and d4). Certainly, a quantity of feed arrays, a quantity of radio frequency channels, and a quantity of reflectors are not limited to this. For example, there may be a plurality of reflectors, and signals sent by a feed are transmitted after being reflected by the plurality of reflectors a plurality of times.

In FIG. 2, four single-pole multi-throw switches are used to control a correspondence between a radio frequency channel and a feed. A radio frequency channel is in a one-to-one correspondence with a single-pole multi-throw switch. A radio frequency channel is connected to a single-pole end of a single-pole multi-throw switch, that is, the radio frequency channel 13*a* is connected to a single-pole end of a single-pole multi-throw switch 14*a*, the radio frequency channel 13*b* is connected to a single-pole end of a single-pole multi-throw switch 14*b*, the radio frequency channel 13*c* is connected to a single-pole end of a single-pole multi-throw switch 14*c*, and the radio frequency channel 13*d* is connected to a single-pole end of a single-pole multi-throw switch 14*d*. One single-pole multi-throw switch corresponds to a plurality of feeds, and the feeds are connected to multi-throw ends of the single-pole multi-throw switch, that is, multi-throw ends of the single-pole multi-throw switch 14*a* are respectively connected to a1, a2, a3, and a4 in the feed array, multi-throw ends of the single-pole multi-throw switch 14*b* are respectively connected to b1, b2, b3, and b4 in the feed array, multi-throw ends of the single-pole multi-throw switch 14*c* are respectively connected to c1, c2, c3, and c4 in the feed array, and multi-throw ends of the single-pole multi-throw switch 14*d* are respectively connected to d1, d2, d3, and d4 in the feed array. In this example, each single-pole multi-throw switch is connected to only four feeds in the feed array and the four feeds do not conflict with each other. This is merely for ease of description, and actual application is not limited to this.

In FIG. 2, the feed array and the four single-pole multi-throw switches are further connected by using a cross waveguide, so as to facilitate implementation of products, or certainly, may be alternatively connected in another manner.

The radio frequency channel may specifically include a transmit radio frequency channel and/or a receive radio frequency channel. If the radio frequency channel includes a transmit radio frequency channel, the transmit radio frequency channel includes a phase shifter and/or an adjustable gain amplifier, where the phase shifter is configured to control a phase of a to-be-transmitted signal, and the adjustable gain amplifier is configured to control an amplitude of a to-be-transmitted signal. A quantity of transmit radio frequency channels is O, and O is an integer greater than 1 and less than or equal to M. The antenna may further include a divider, configured to: divide to-be-transmitted signals into O channels of signals and send the O channels of signals to the O transmit radio frequency channels respectively. If the radio frequency channel includes a receive radio frequency channel, the receive radio frequency channel includes a phase shifter and/or an adjustable gain amplifier, where the phase shifter is configured to control a phase of a received signal, and the adjustable gain amplifier is configured to control an amplitude of a received signal. A quantity of receive radio frequency channels is P, and P is an integer greater than 1 and less than or equal to M. The antenna further includes a combiner, configured to combine received signals of the P receive radio frequency channels.

In the embodiment of FIG. 2, each radio frequency channel includes both a transmit radio frequency channel and a receive radio frequency channel. A transmit radio frequency channel of the radio frequency channel 13*a* includes a phase shifter 131*a*, an adjustable gain amplifier 132*a*, and an amplifier 133*a*. A receive radio frequency channel of the radio frequency channel 13*a* includes a low noise amplifier 135*a*, an adjustable gain amplifier 136*a*, and a phase shifter 137*a*. The transmit radio frequency channel and the receive radio frequency channel of the radio frequency channel 13*a* are connected to a single-pole multi-throw switch by using a duplexer 134*a*. Another radio frequency channel has a similar structure, and details are not described herein again.

In the embodiment of FIG. 2, the quantity of transmit radio frequency channels is 4. The antenna may further include a divider 16, configured to: divide to-be-transmitted signals into four channels of signals and send the four channels of signals to the four transmit radio frequency channels respectively. The quantity of receive radio frequency channels is 4. The antenna may further include a combiner 17, configured to combine received signals of the four receive radio frequency channels.

In the embodiment of FIG. 2, in a transmit state, to-be-transmitted signals are first sent to the four transmit radio frequency channels by using the divider 16, then are sent to corresponding feeds by using corresponding single-pole multi-throw switches, and are radiated outwards by using reflection of a reflector, where a direction of beams radiated outwards can be finely controlled by adjusting an adjustable gain amplifier and/or a phase shifter, and a direction of beams radiated outwards can be widely controlled by controlling a single-pole multi-throw switch. In a receive state, received signals are reflected by the reflector to feeds and are transmitted to the corresponding receive radio frequency channels, and then the combiner 17 combines the received signals of the four receive radio frequency channels, where a direction of beams of the received signals can be finely controlled by adjusting an adjustable gain amplifier and/or a phase shifter, and a direction of beams of the received signals can be widely controlled by controlling a single-pole multi-throw switch.

FIG. 4 shows a method for alignment by using the foregoing reflector antenna, and the method includes the following steps:

S401. Set a correspondence between a radio frequency channel and a feed as a test correspondence.

S402. Detect power of a signal received by each radio frequency channel.

S403. Determine an alignment correspondence between the radio frequency channel and the feed according to the power of the signal received by the radio frequency channel.

S404. Set the correspondence between a radio frequency channel and a feed as the alignment correspondence.

S405. The radio frequency channel transmits or receives a signal by using a feed corresponding to the alignment correspondence.

In the alignment correspondence between the radio frequency channel and the feed, feeds corresponding to the radio frequency channel are adjacent.

In the test correspondence in S401, the feeds corresponding to the radio frequency channel may be located at the edge of a feed array.

In the test correspondence in S401, the feeds corresponding to the radio frequency channel may be evenly distributed around the center of a feed array.

In S403, the determining an alignment correspondence between the radio frequency channel and the feed according to the power of the signal received by the radio frequency channel may specifically include: determining a direction of arrival according to the power of the signal received by the radio frequency channel; and determining, according to the direction of arrival, the alignment correspondence between the radio frequency channel and the feed.

Before S405, the method may further include: adjusting a phase shifter and/or an adjustable gain amplifier of a receive radio frequency channel, and optimizing an MSE of a received signal obtained after the combiner performs combination.

The following describes in detail an alignment method by using the reflector antenna in FIG. 2 and FIG. 3 as an example.

The single-pole multi-throw switch 14*a* is first disposed, so that the radio frequency channel 13*a* corresponds to the feed a1; the single-pole multi-throw switch 14*b* is disposed, so that the radio frequency channel 13*b* corresponds to the feed b2; the single-pole multi-throw switch 14*c* is disposed, so that the radio frequency channel 13*c* corresponds to the feed c3; the single-pole multi-throw switch 14*d* is disposed, so that the radio frequency channel 13*d* corresponds to the feed d4. That is, the feeds corresponding to the radio frequency channels are located in four corners of the feed array.

The power of the signal received by the radio frequency channel is detected. For example, power and/or a phase of the radio frequency channel 13*a* may be detected behind the duplexer 134*a*, that is, power and/or a phase corresponding to the feed a1 are/is detected; power and/or a phase of the radio frequency channel 13*b* may be detected behind a duplexer 134*b*, that is, power and/or a phase corresponding to the feed b2 are/is detected; power and/or a phase of the radio frequency channel 13*c* may be detected behind a duplexer 134*c*, that is, power and/or a phase corresponding to the feed c3 are/is detected; power and/or a phase of the radio frequency channel 13*d* may be detected behind a duplexer 134*d*, that is, power and/or a phase corresponding to the feed d4 are/is detected.

For simplicity, in this embodiment, in the alignment correspondence between the radio frequency channel and the feed, feeds corresponding to the radio frequency channel are adjacent. Therefore, there are nine optional alignment correspondences, which are respectively: (a1, b1, c1, d1), (b1, a2, d1, c2), (a2, b2, c2, d2), (c1, d2, a3, b3), (d1, c2, b3, a4), (c2, d2, a4, b4), (a3, b3, c3, d3), (b3, a4, d3, c4), and (a4, b4, c4, d4), these nine optional alignment correspondences are distributed across the entire feed array, and a scanning angle is large during alignment correspondence selection.

An optimal correspondence in the nine optional alignment correspondences may be determined according to power and/or phases of received signals of the four radio frequency channels. For example, if power of a received signal of a radio frequency channel corresponding to the feed a1 is significantly greater than power of a received signal of another radio frequency channel, (a1, b1, c1, d1) may be selected as an alignment correspondence. Certainly, this is only an example for simplicity, and an actual determining process is more complex.

For example, a table of correspondences between power of received signals of the four radio frequency channels and directions of arrival is established according to theoretical calculation. A direction of arrival is determined according to the table, and then the alignment correspondence between the radio frequency channel and the feed is determined according to a table of correspondences between directions of arrival and alignment correspondences. Certainly, alternatively, a table of correspondences between power of received signals of the four radio frequency channels and alignment correspondences may be directly established.

An alignment correspondence selection process may be considered as a coarse scanning process. After an alignment correspondence is selected, that is, each single-pole multi-throw switch has been configured, a phase shifter and/or an adjustable gain amplifier of a receive radio frequency channel may be adjusted, and an MSE of a received signal obtained after the combiner performs combination may be optimized, so as to implement fine alignment. The process of adjusting the phase shifter may be considered as a fine scanning process.

Certainly, alignment may be alternatively performed by using another alignment method. For example, nine alignment correspondences are traversed, and then an alignment correspondence that needs to be selected is obtained by using calculation. For example, a correspondence is selected according to received signal power of the combiner, and in this case, a phase shifter does not work, or all parameters of a phase shifter are set to be the same.

The reflector antenna in the embodiments of the present disclosure can use a few radio frequency channels to ensure that a high-gain antenna has a relatively large scanning angle, supports seamless coverage, and has no grating lobe. The reflector antenna obtains a relatively strong beam scanning capability by using coarse scanning and fine scanning, so as to facilitate installation alignment and resist shaking, also lead to lower costs and power consumption, and facilitate implementation of products.

Persons skilled in the art should understand that the embodiments of the present disclosure may be provided as a method, a system, or a computer program product. Therefore, the present disclosure may use a form of hardware only embodiments, software only embodiments, or embodiments with a combination of software and hardware. Moreover, the present disclosure may use a form of a computer program product that is implemented on one or more computer-usable storage media (including but not limited to a disk memory, a CD-ROM, and an optical memory) that include computer-usable program code.

The present disclosure is described with reference to the flowcharts and/or block diagrams of the method, the device (system), and the computer program product according to the embodiments of the present disclosure. It should be understood that computer program instructions may be used to implement each process and/or each block in the flowcharts and/or the block diagrams and a combination of a process and/or a block in the flowcharts and/or the block diagrams. These computer program instructions may be provided for a general-purpose computer, a dedicated computer, an embedded processor, or a processor of any other programmable data processing device, so that the instructions executed by the computer or the processor of any other programmable data processing device may implement a specific function in one or more processes in the flowcharts and/or in one or more blocks in the block diagrams.

These computer program instructions may be stored in a computer readable memory that can instruct the computer or any other programmable data processing device to work in a specific manner, so that the instructions stored in the computer readable memory generate an artifact that includes an instruction apparatus. The instruction apparatus implements a specific function in one or more processes in the flowcharts and/or in one or more blocks in the block diagrams.

These computer program instructions may also be loaded onto a computer or another programmable data processing device, so that a series of operations and steps are performed on the computer or the another programmable device, thereby generating computer-implemented processing. Therefore, the instructions executed on the computer or the another programmable device provide steps for implementing a specific function in one or more processes in the flowcharts and/or in one or more blocks in the block diagrams.

Although some embodiments of the present disclosure have been described, persons skilled in the art can make changes and modifications to these embodiments once they learn the basic inventive concept. Therefore, the following claims are intended to be construed as to cover the embodiments and all changes and modifications falling within the scope of the present disclosure.

Apparently, persons skilled in the art can make various modifications and variations to the present disclosure without departing from the scope of the present disclosure. The present disclosure is intended to cover these modifications and variations provided that they fall within the scope of protection defined by the following claims and their equivalent technologies.

What is claimed is:

1. A reflector antenna, comprising:

a feed array comprising N feeds, wherein N is an integer greater than 1;

a reflector configured to:

reflect a signal from the feed array, or reflect a signal to the feed array; and M radio frequency channels each comprising at least one of an adjustable gain amplifier and a phase shifter, configured to control a signal, each radio frequency channel corresponding to a one of the N feeds, the correspondence between the radio frequency channels and the N feeds is changeable, and each radio frequency channel for transmitting or receiving a signal using the corresponding N feeds, and wherein M is an integer greater than 1 and less than N, wherein at least one of the M radio frequency channels comprises a transmit radio frequency channel comprising the phase shifter configured to control a phase of a to-be-transmitted signal and a transmit radio frequency channel comprising the adjustable gain amplifier configured to control an amplitude of a to-be-transmitted signal.

2. The reflector antenna according to claim 1, further comprising:

M single-pole multi-throw switches, wherein one radio frequency channel corresponds to one single-pole multi-throw switch that corresponds to a number of the N feeds, the radio frequency channel is connected to a single-pole end of the single-pole multi-throw switch and the number of the N feeds are connected to multi-throw ends of the single-pole multi-throw switch, and a correspondence between the radio frequency channel and the number of the N feeds is controlled by the single-pole multi-throw switch.

3. The antenna according to claim 2, wherein the plurality of feeds are connected to the multi-throw ends of the single-pole multi-throw switch by using a cross waveguide.

4. The antenna according to claim 1, wherein:

a quantity of the M radio frequency channels that comprise a transmit radio frequency channel is O, and O is an integer greater than 1 and less than or equal to M; and the antenna further comprises:

a divider, configured to divide to-be-transmitted signals into O channels of signals and send the O channels of signals to the O transmit radio frequency channels respectively.

5. The antenna according to claim 1, wherein at least one of the M radio frequency channels comprises a receive radio frequency channel comprising the phase shifter configured to control a phase of a received signal.

6. The antenna according to claim 1, wherein at least one of the M radio frequency channels comprises a receive radio frequency channel comprising the adjustable gain amplifier configured to control an amplitude of a received signal.

7. The antenna according to claim 5, wherein:

a quantity of the M radio frequency channels that comprise a receive radio frequency channel is P, and P is an integer greater than 1 and less than or equal to M; and the antenna further comprises:

a combiner, configured to combine received signals of the P receive radio frequency channels.

* * * * *